US006712933B2

(12) United States Patent
Karve et al.

(10) Patent No.: US 6,712,933 B2
(45) Date of Patent: Mar. 30, 2004

(54) PAPERMAKING PULP AND FLOCCULANT COMPRISING ACIDIC ACQUEOUS ALUMINA SOL

(75) Inventors: Mohan D. Karve, Memphis, TN (US); Rosa M. Covarrubias, Bartlett, TN (US); Gerald M. Dykstra, Bartlett, TN (US); Saleem Mirza, Bartlett, TN (US)

(73) Assignee: Buckman Laboratories International, Inc., Memphis, TN (US)

( * ) Notice: Subject to any disclaimer, the term of this patent is extended or adjusted under 35 U.S.C. 154(b) by 0 days.

(21) Appl. No.: 09/860,023

(22) Filed: May 17, 2001

(65) Prior Publication Data

US 2002/0033245 A1 Mar. 21, 2002

Related U.S. Application Data

(60) Provisional application No. 60/205,012, filed on May 17, 2000.

(51) Int. Cl.[7] ..... D21H 17/33; D21H 17/65

(52) U.S. Cl. ..... 162/158; 162/164.1; 162/168.3; 162/181.4; 162/181.5; 162/183

(58) Field of Search ..... 162/158, 164.1, 162/168.3, 183, 181.5, 181.4

(56) References Cited

U.S. PATENT DOCUMENTS

| | | | | | |
|---|---|---|---|---|---|
| 2,915,475 | A | | 12/1959 | Bugosh | 252/313 |
| 2,917,426 | A | * | 12/1959 | Bugosh | 162/181.5 |
| 3,234,075 | A | * | 2/1966 | Bratberg | 162/181.5 |
| 4,753,710 | A | | 6/1988 | Langley et al. | 162/164.3 |
| 4,798,653 | A | | 1/1989 | Rushmere | 162/168.3 |
| 4,894,119 | A | | 1/1990 | Baron, Jr. et al. | 162/168.2 |
| 4,913,774 | A | | 4/1990 | Goguelin | 162/158 |
| 5,015,334 | A | | 5/1991 | Derrick | 162/168.1 |
| 5,169,497 | A | * | 12/1992 | Sarkar et al. | 162/158 |
| 5,221,435 | A | * | 6/1993 | Smith | 162/164.1 |
| 5,356,800 | A | | 10/1994 | Jaquess | 435/188 |
| 5,496,440 | A | * | 3/1996 | Carre et al. | 162/168.3 |
| 5,507,914 | A | * | 4/1996 | Sarkar et al. | 162/100 |
| 5,571,379 | A | | 11/1996 | Derrick | 162/168.1 |
| 5,989,515 | A | | 11/1999 | Watanabe et al. | 423/625 |

FOREIGN PATENT DOCUMENTS

| | | |
|---|---|---|
| WO | WO 97/41063 | 11/1997 |
| WO | WO 99/43780 | 9/1999 |
| WO | WO 00/53532 | 9/2000 |

OTHER PUBLICATIONS

Smook, G. A.; "Handbook for Pulp and Paper Technologists", 1982, TAPPI, Atlanta, USA pp. 208–243.

Copy of International Search Report PCT/US01/16075, dated Jan. 30, 2002.

Copy of U.S. patent application No. 09/803,225, filed Mar. 9, 2001.

Copy of International Search Report PCT/US01/07951.

* cited by examiner

*Primary Examiner*—Peter Chin

(74) *Attorney, Agent, or Firm*—Kilyk & Bowersoc, P.L.L.C.

(57) ABSTRACT

Methods of making paper or paperboard are described. According to one of the methods, an acidic aqueous alumina sol is introduced to a papermaking pulp to form a treated pulp having improved retention properties. The acidic aqueous alumina sol preferably has a pH of from about 3 to about 6. The sol preferably contains elongate secondary particles which are elongated from about 50 nm to about 300 nm in only one plane and formed by edge-to-edge coagulation of rectangular plate like primary particles having a length on one side of from about 10 nm to about 30 nm when observed through an electron microscope. The pulp may also be treated with at least one coagulant, at least one flocculant, at least one cationic starch, at least one cellulytic enzyme, at least one biocide, and/or other conventional papermaking pulp additives. The resulting pulp is formed into a sheet of pulp and then drained to form a paper or paperboard. Other papermaking processes are also described as is a papermaking apparatus for carrying out the methods. Paper and paperboard containing dried pulp that has been treated with an acidic aqueous alumina sol are also described. Methods to flocculate particulate materials in a dispersion are also described.

21 Claims, 3 Drawing Sheets

PAPERMAKING PULP AND FLOCCULANT COMPRISING ACIDIC ACQUEOUS ALUMINA SOL

This application claims the benefit under 35 U.S.C. § 119(c) of prior U.S. Provisional Patent Application No. 60/205,012 filed May 17, 2000, which is incorporated in its entirety by reference herein.

BACKGROUND OF THE INVENTION

The present invention relates to papermaking pulps, papermaking processes employing the pulps, and paper and paperboard products made from the pulps. More particularly, the present invention relates to treating papermaking pulp with at least one microparticle-containing retention aid system.

Microparticles and other particulate materials have been added to papermaking pulps as retention aids. For example, U.S. Pat. No. 4,798,653 to Rushmere, which is incorporated herein in its entirety by reference, describes a papermaking stock including cellulose fibers and a two-component combination of an anionic polyacrylamide and a cationic colloidal silica sol.

One problem with microparticle sols that have been employed in papermaking pulps has been with instability. Because of the instability of sols used in connection with papermaking pulps, the sols are often made on-site for immediate delivery to a papermaking process. A need exists for a stable microparticle sol retention aid for use in papermaking processes which can be formed off-site, exhibits a long shelf life, and can be shipped to a papermaking plant for immediate or future use in a papermaking process.

A need also exists for a papermaking pulp that exhibits even better retention of fines and even better resistance to shear forces during a papermaking process. A need also exists for a papermaking pulp that produces a paper or paperboard product with improved strength characteristics.

SUMMARY OF THE INVENTION

The present invention relates to the use of an acidic aqueous alumina sol as a retention aid for a papermaking pulp or stock. The acidic aqueous alumina sol preferably has a pH of from about 3 to about 6. The sol preferably contains elongate secondary particles which are elongated from about 50 nm to about 300 nm in only one plane and formed by edge-to-edge coagulation of rectangular plate-like primary particles having a length on one side of from about 10 nm to about 30 nm when observed through an electron microscope. The acidic aqueous alumina sol is preferably very stable, preferably has a long shelf life, and/or can preferably be made off-site then shipped to a papermaking mill for future use. The pulp or stock may also contain or be treated with at least one coagulant, at least one flocculant, at least one filler, at least one polyacrylamide, at least one cationic starch, and/or other conventional pulp additives. The resulting pulp or stock is then formed into a wet sheet of pulp or stock, having improved retention properties compared to a wet sheet made of conventionally treated pulp. After drainage and drying, the resulting paper or paperboard preferably exhibits excellent opaqueness and/or other desirable physical properties.

The acidic aqueous alumina sol used in the papermaking pulps of the present invention can also be used, according to embodiments of the present invention, for the treatment of waste water streams and textile dye streams.

It is to be understood that both the foregoing general description and the following detailed description are exemplary and explanatory only and are only intended to provide a further explanation of the present invention, as claimed. The accompanying drawings, which are incorporated in and constitute a part of this application, illustrate several exemplary embodiments of the present invention and together with description, serve to explain the principles of the present invention.

DETAILED DESCRIPTION OF THE PRESENT INVENTION

Figure 1:
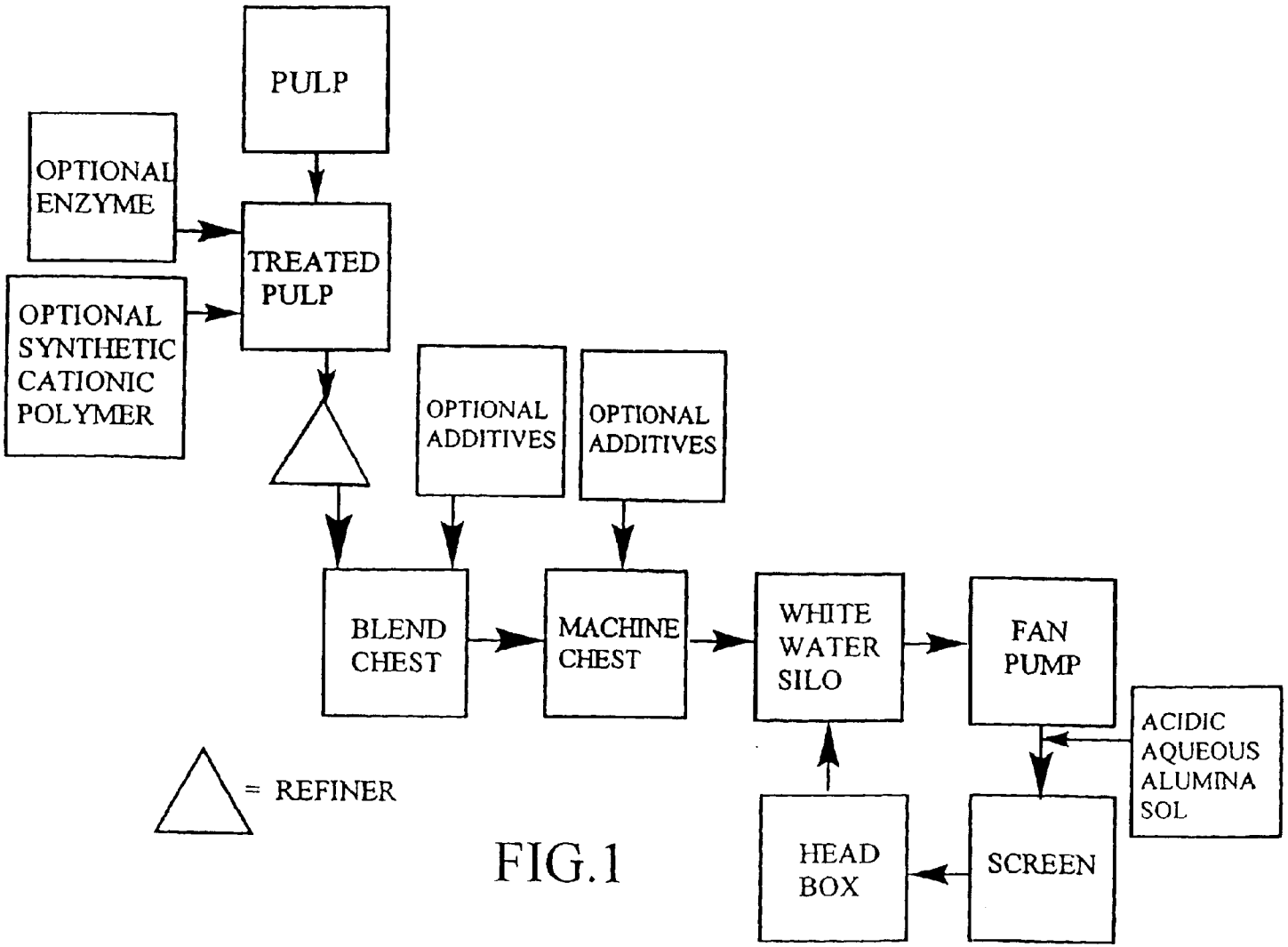
FIG. 1 is a flow chart showing a papermaking process according to an embodiment of the present invention.

The present invention relates to the use of at least one acidic aqueous alumina sol as a retention aid for a papermaking pulp. Paper and paperboard products made according to the method preferably exhibit excellent opaqueness and/or other desirable physical properties. Sheets of pulp from which the paper and paperboard products are made preferably exhibit excellent drainage and/or excellent retention of pulp fines.

The acidic aqueous alumina sol preferably contains elongated secondary particles that are preferably elongated from about 50 nm to about 300 nm in only one plane and are preferably formed by edge-to-edge coagulation of rectangular plate-like primary particles preferably having a length on one side of from about 10 nm to about 30 nm when observed through an electron microscope.

Preferred stable acidic aqueous alumina sols of this type can preferably be made by various processes. An exemplary process includes the steps of: (A) adding an alkali to an aqueous alumina sol containing fibrous colloidal particles of an amorphous alumina hydrate to produce a reaction mixture having a pH of from about 9 to about 12, (B) subjecting the reaction mixture obtained in step (A) to a hydrothermal treatment at a temperature of from about 110° C. to about 250° C. to produce an aqueous suspension containing an alumina hydrate having a boehmite structure, and (C) desalting the aqueous suspension obtained in step (B) by adding water and an acid by ultrafiltration to form an acidic aqueous alumina sol having a pH of from about 3 to about 6.

According to another exemplary process, a stable acidic aqueous alumina sol can be made of particles having an alumina hydrate boehmite structure wherein the stable acidic aqueous alumina sol contains elongate secondary particles which are elongated from about 50 nm to about 300 nm in only one plane and formed by edge-to-edge coagulation of rectangular plate-like primary particles having a length on one side of from about 10 nm to about 30 nm when observed through an electron microscope. The process comprises the steps of: (a) adding an alkali to an aqueous alumina sol containing fibrous colloidal particles of an amorphous alumina hydrate to produce a reaction mixture having a pH of from about 9 to about 12, (b) subjecting the reaction mixture obtained in step (a) to a hydrothermal treatment at a temperature of from about 110° C. to about 250° C. to produce an aqueous suspension containing an alumina hydrate having a boehmite structure, and (c) contacting a hydrogen-type acid cation-exchange resin and a hydroxyl-type strong-base anion-exchange resin to the aqueous suspension obtained in step (b) to form an acidic aqueous alumina sol having a pH of from about 3 to about 6.

According to yet another exemplary process for producing an aluminate hydrate having a boehmite structure and a stable acidic aqueous alumina sol containing elongate secondary particles which are elongated from about 50 nm to about 300 nm in only one plane and formed by edge-to-edge coagulation of rectangular plate-like primary particles having a length of one side of from about 10 nm to about 30 nm when observed through an electron microscope. The process comprises the steps of: (A') adding an alkali to an aqueous alumina sol containing fibrous colloidal particles of an amorphous alumina hydrate to produce a reaction mixture having a pH of from about 9 to about 12, (B') desalting the reaction mixture obtained in step (A') by adding water by cake filtration to form a desalted reaction mixture having a pH of from about 9 to about 12, (C') subjecting the desalted reaction mixture obtained in the step (B') to a hydrothermal treatment at a temperature of from about 110° C. to about 250° C. to produce an aqueous suspension containing an alumina hydrate having a boehmite structure, and (D') adding an acid to the aqueous suspension obtained in the step (C') to form an acidic aqueous alumina sol having a pH of from about 3 to about 6.

According to yet another exemplary process for producing a high-concentration and stable acidic aqueous alumina sol, the process comprises mechanically dispersing the stable acidic aqueous alumina sol obtained by any one of the above exemplary processes and concentrating the sol.

Exemplary stable acidic aqueous alumina sols that can be used as retention aids in accordance with the present invention, and processes for making the same, are described, for example, in U.S. Pat. No. 5,989,515 to Wantanabe et al., which is incorporated herein in its entirety by reference.

The acidic aqueous alumina sol can be added in any amount sufficient to improve the retention of fines when the pulp or stock is formed into a wet sheet or web. Preferably, the acidic aqueous alumina sol is added in an amount of at least about 0.05 pound per ton of paperstock, based on the dried solids weight of both the sol and the paperstock or pulp, and more preferably in an amount of at least about 0.2 pound per ton of paperstock. Even more preferably, the acidic aqueous alumina sol is added in an amount of from about 0.3 pound per ton of paperstock to about 5.0 pounds per ton of paperstock, based on the dried solids weight of both the sol and the paperstock. The acidic aqueous alumina sol may preferably be added in an amount of from about 0.01% by weight to about 0.5% by weight based on the dried solids weight of both the sol and the paperstock or pulp. For purposes of this patent application, the terms "pulp", "stock", and "paperstock" are used interchangeably.

The acidic aqueous alumina sol retention aid in accordance with the present invention can be added before or after significant shear steps in the papermaking process. Preferably, the retention aid is added after the machine chest or stuff box if the papermaking system includes a machine chest and/or a stuff box. Good papermaking properties can be achieved even when the acidic aqueous alumina sol is added after the last significant shear step in the papermaking process. Preferably, the acidic aqueous alumina sol is added after a polymeric coagulant has been added to the pulp and after at least one significant shear step in the papermaking process.

The papermaking pulp or stock can be any conventional type, and, for instance, can contain cellulose fibers in an aqueous medium at a concentration of preferably at least about 50% by weight based on the total dried solids content of the pulp or paperstock. The sol can be added to many different types of papermaking pulp, stock, or combinations of pulps or stocks. For example, the pulp may comprise virgin and/or recycled pulp, such as virgin sulfite pulp, broke pulp, a hardwood kraft pulp, a softwood kraft pulp, mixtures of such pulps, and the like.

The retention aid can be added to the pulp or stock in advance of depositing the pulp or stock onto a papermaking wire. The pulp or stock containing the retention aid has been found to exhibit good dewatering during formation of the paperweb on the wire. The pulp or stock also exhibits a desirable high retention of fiber fines and fillers in the paperweb products under conditions of high shear stress imposed upon the pulp or stock.

In addition to the acidic aqueous alumina sol retention aid used in accordance with the present invention, the papermaking pulp or stock according to the present invention may further contain another microparticle, for example, a synthetic hectorite microparticle additive. The other microparticle additive can be a natural or synthetic hectorite, bentonite, zeolite, non-acidic alumina sol, or any conventional particulate additives as are known to those skilled in the art.

Exemplary synthetic hectorite microparticle additives include LAPONITE available from Laporte Industries, and the synthetic microparticles described in U.S. Pat. Nos. 5,571,379 and 5,015,334, which are incorporated herein in their entireties by reference. If included in the pulps or stocks of the present invention, a synthetic hectorite microparticle additive can be present in any effective amount, such as from about 0.1 pound per ton of paperstock, based on the dried solids weight of both the additive and the paperstock, to about 2.0 pounds per ton of paperstock. Preferably, if a synthetic hectorite microparticle is included, it is added to the pulp or stock in an amount of from about 0.3 pound per ton of paperstock to about 1.0 pound per ton of paperstock, based on the dried solids weight of both the microparticle and the paperstock.

In addition to the acidic aqueous alumina sol retention aid used in accordance with the present invention, the papermaking pulps or stocks according to the present invention may further contain a coagulant/flocculant retention system. Exemplary coagulant/flocculant systems that may be used can include, for example, an inorganic coagulant such as alum (alumina sulphate), or a cationic starch, or a low molecular weight synthetic cationic polymer. Preferably, the coagulant reduces the negative surface charges present on particles in the paperstock, particularly, the surface charges of the cellulosic fines and mineral fillers, and thereby accomplishes some degree of agglomeration of such particles.

After the addition of a coagulant, and preferably after the various significant shear steps of the refining process, a flocculant can then preferably be added, and can include, for example, a synthetic anionic polymer, or other types of conventional flocculants.

The aqueous cellulosic papermaking pulp or paperstock can be treated by first adding a polymer to the pulp followed by subjecting the pulp to high shear conditions, followed by the addition of the acidic aqueous alumina sol prior to sheet formation. Any conventional papermaking polymer can be used. The polymer is preferably a cationic polymer, a nonionic polymer, or an amphoteric polymer. If the polymer is an amphoteric polymer, it is preferably used under cationic conditions. The polymer can be, for example, a high molecular weight linear cationic polymer, a branched polyethylene oxide, a polyamidoamineglycol (PAAG) polymer, or the like. Exemplary high molecular weight linear cationic polymers and shear stage processing suitable for use in such an embodiment are described in U.S. Pat. Nos. 4,753,710 and 4,913,775, which are both incorporated herein in their entireties by reference. At least one other polymer can be used in addition to at least one of the polymers recited above provided the other polymer does not substantially adversely affect the desirable properties achieved according to the present invention.

The papermaking pulps or stocks of the present invention can contain a cationic polymer composition. If employed, the cationic polymer composition is preferably added in an amount effective to improve the drainage or retention of the pulp compared to the same pulp but having no cationic polymer present. In general, the cationic polymer is preferably added in an amount of at least about 0.05 pound per ton of paperstock, based on the dried solids weight of both the polymer and the pulp, and preferably in an amount of at least about 0.1 pound per ton of paperstock. Preferably, the cationic polymer is added in an amount of from about 0.2 pound per ton of paperstock to about 2.5 pounds per ton of paperstock, based on dried solids weights.

If a cationic polymer is employed or an amphoteric polymer under cationic conditions, the polymer is preferably added in an amount of from about 5 grams to about 500 grams per ton of paperstock based on the dried solids weight of both the polymer and the paperstock. More preferably, under such circumstances, the polymer is added in an amount of from about 20 grams to about 200 grams, and even more preferably from about 50 grams to about 100 grams, per ton of paperstock based on the dried solids weight of both the polymer and the paperstock.

Any cationic polymer or mixture thereof may be used and preferably conventional cationic polymers commonly associated with papermaking can be used in the pulps or stocks of the present invention. Examples of cationic polymers include, but are not limited to, cationic starches and cationic polyacrylamide polymers, for example, copolymers of an acrylamide with a cationic monomer, wherein the cationic monomer may be in a neutralized or quaternized form. Nitrogen-containing cationic polymers are preferred. Exemplary cationic monomers which may be copolymerized with acrylamide to form preferred cationic polymers useful according to the present invention, include amino alkyl esters of acrylic or methacrylic acid, and diallylamines in either neutralized or quaternized form. Exemplary cationic monomers and cationic polyacrylamide polymers are described in U.S. Pat. No. 4,894,119 to Baron, Jr., et al., which is incorporated herein in its entirety by reference.

If a polymer is added, it may also be a polyacrylamide formed from comonomers that include, for example, 1-trimethylammonium-2-hydroxypropylmethacrylate methosulphate. Other examples of suitable polymers, include, but are not limited to, homopolymers of diallylamine monomers, homopolymers of aminoalkylesters of acrylic acids, and polyamines, as described in U.S. Pat. No. 4,894,119. Co-polymers, ter-polymers, or higher forms of polymers may also be used. Further, for purposes of the present invention, a mixture of two or more polymers may be used.

When a cationic polymer is used and contains a cationic polyacrylamide, nonionic acrylamide units are preferably present in the copolymer, and preferably present in an amount of at least about 30 mol % and generally in an amount of no greater than 95 mol %. From about 5 mol % to about 70 mol % of the polymer is preferably formed from a cationic comonomer.

The acidic aqueous alumina sol retention aid used in accordance with the present invention can be used in conjunction with a polyacrylamide that can be added before, simultaneously with, or after addition of the acidic aqueous alumina sol retention aid. If the retention aid carries a cationic charge, an anionic polyacrylamide can preferably be used together with the retention aid. If the retention aid carries an anionic charge, a cationic polyacrylamide can preferably be used with the retention aid. Cationic polyacrylamides are described in more detail above. Regardless of charge, the polyacrylamide may have a molecular weight in excess of 100,000, and preferably between about 5,000,000 and 25,000,000. Suitable anionic polyacrylamides for use in the pulps and paperstocks according to the present invention include those described in U.S. Pat. No. 4,798,653 which is incorporated herein in its entirety by reference. The combination of the acidic aqueous alumina sol and a polyacrylamide provides a suitable balance between freeness, dewatering, fines retention, good paper formation, strength, and resistance to shear.

One particular additive for use according to the methods of the present invention is a cationic starch. Cationic starch may be added to the pulp or stock of the present invention to form a starch treated pulp. Starch may be added at one or more points along the flow of papermaking pulp through the papermaking apparatus or system of the present invention. For instance, cationic starch can be added to a pulp at about the same time that the acidic aqueous alumina sol is added to the pulp. Preferably, if a cationic starch is employed, it is added to the pulp or combined with the pulp prior to introducing the acidic aqueous alumina sol to the pulp. The cationic starch can alternatively or additionally be added to the pulp after the pulp is first treated with an enzyme, a coagulant, or both. Preferred cationic starches include, but are not limited to, potato starches, corn starches, and other wet-end starches, or combinations thereof.

Conventional amounts of starch can be added to the pulp. An exemplary amount of starch that can be used according to the present invention is from about 5 to about 25 pounds per ton based on the dried solids weight of the pulp.

The papermaking pulps of the present invention may also contain a conventional papermaking pulp-treating enzyme that has cellulytic activity. Preferably, the enzyme composition also exhibits hemicellulytic activity. Suitable enzymes and enzyme-containing compositions include those described in U.S. Pat. No. 5,356,800 to Jaquess, U.S. patent application Ser. No. 09/031,830 filed Feb. 27, 1998, and International Publication No. WO 99/43780, all incorporated herein in their entireties by reference. Other exemplary papermaking pulp-treating enzymes are BUZYME™ 2523 and BUZYME™ 2524, both available from Buckman Laboratories International, Inc., Memphis, Tenn. A preferred cellulytic enzyme composition preferably contains from about 5% by weight to about 20% by weight enzyme. The preferred enzyme composition can further contain polyethylene glycol, hexylene glycol, polyvinylpyrrolidone, tetrahydrofuryl alcohol, glycerine, water, and other conventional enzyme composition additives, as for example, described in U.S. Pat. No. 5,356,800. The enzyme may be added to the pulp in any conventional amount, such as in an amount of from about 0.001% by weight to about 0.100% by weight enzyme based on the dry weight of the pulp, for example, from about 0.005% by weight to about 0.05% by weight.

In a preferred embodiment of the present invention, an enzyme composition is included in the pulp or stock and contains at least one polyamide oligomer and at least one enzyme. The polyamide is present in an effective amount to stabilize the enzyme. Exemplary enzyme compositions containing polyamide oligomers and enzymes are described in International Published Application No. WO 99/43780, which is incorporated herein in its entirety by reference.

If an enzyme composition is included, it can include a combination of two or more different enzymes. The enzyme composition can include, for example, a combination of a lipase and a cellulose, and optionally can include a stabilizing agent. The stabilizing agent may be a polyamide oligomer as described herein.

A biocide may be added to the pulp in accordance with conventional uses of biocides in papermaking processes. For example, a biocide may be added to the treated pulp in a blend chest after the pulp has been treated with the enzyme and cationic polymer. Biocides useful in the papermaking pulps according to the present invention include biocides well known to those skilled in the art, for example, biocides available from Buckman Laboratories International, Inc., Memphis, Tennessee, such as BUSAN™ biocides.

The acidic aqueous alumina sol-containing pulps or stocks of the present invention may additionally be treated with one or more other components, including polymers such as anionic and non-ionic polymers, clays, other fillers, dyes, pigments, defoamers, microbiocides, pH adjusting agents such as alum, and other conventional papermaking or processing additives. These additives can be added before, during, or after introduction of the acidic aqueous alumina sol. Preferably, the acidic aqueous alumina sol is added after most, if not all, other additives and components are added to the pulp. Thus, the acidic aqueous alumina sol can be added to the papermaking pulp after the addition of enzymes, coagulants, flocculants, fillers, and other conventional and non-conventional papermaking additives.

The addition of an acidic aqueous alumina sol to a papermaking pulp in accordance with the present invention can be practiced on most, if not all, papermaking machines.

A flow chart of a papermaking system for carrying out the method of the present invention is set forth in FIG. 1. It is to be understood that the system shown is exemplary of the present invention and is in no way intended to restrict the scope of the invention. In the system of FIG. 1, an optional supply of enzyme composition and an optional supply of synthetic cationic polymer composition can optionally separately or simultaneously be combined at desired respective concentrations with a flowing stream of papermaking pulp to form a treated pulp. The supply of pulp shown represents a flow of pulp, as for example, supplied from a pulp holding tank or silo. The supply of pulp shown in FIG. 1 can be a conduit, holding tank, or mixing tank, or other container, passageway, or mixing zone for the flow of pulp. The supply of enzyme composition can be, for example, a holding tank having an outlet in communication with an inlet of a treated pulp tank. The supply of synthetic cationic polymer composition can be, for example, a holding tank having an outlet in communication with an inlet of the treated pulp tank.

The pulp, optionally treated with the enzyme composition and/or cationic polymer, is passed from the treated pulp tank through a refiner and then through a blend chest. Optional additives, for example, starch, a biocide, pH adjusting agents, and the like, may be combined with the pulp or treated pulp at the blend chest, machine chest, and/or at other locations along the flow of pulp through the system. Conventional valving and pumps used in connection with introducing conventional additives can be used. The refiner has an inlet in communication with an outlet of the treated pulp tank, and an outlet in communication with an inlet of the blend chest.

According to the embodiment of FIG. 1, the pulp treated in the blend chest is passed from an outlet of the blend chest through a communication to an inlet of a machine chest. The blend chest and machine chest can be of any conventional type known to those skilled in the art. The machine chest ensures a level head, that is, a constant pressure on the treated pulp or stock throughout the downstream portion of the system, particularly at the head box.

From the machine chest, the pulp is passed to a white water silo and then to a fan pump. From the fan pump, the pulp is pumped to a screen and the screened pulp is passed to a headbox where a wet papersheet is made on a wire and drained. In the system of FIG. 1, drained pulp resulting from papermaking in the headbox is recirculated to the white water silo. The paperweb produced on a forming wire in the headbox is drained and dried to form a paper or paperboard product.

Figure 2:
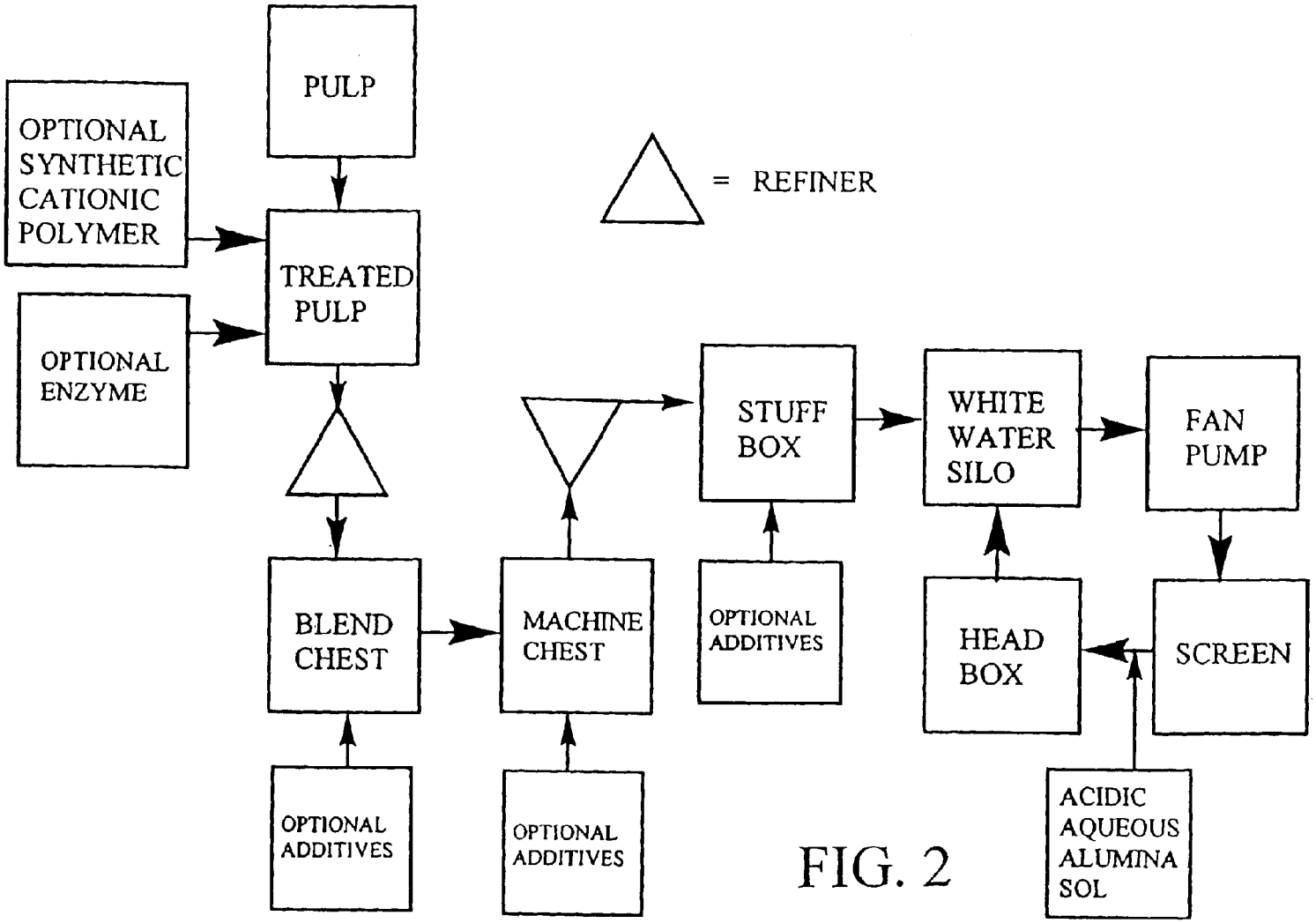
FIG. 2 is a flow chart showing a papermaking process according to another embodiment of the present invention.

In the embodiment shown in FIG. 2, the system includes a conventional stuff box. An acidic aqueous alumina sol is added to the refined treated pulp between the screen and the head box. Additional acidic aqueous alumina sol and an optional cationic starch can be added at the stuff box or elsewhere in the system although not depicted in FIG. 2. The system of FIG. 2 has a second refiner between the machine chest and the stuff box. Other additives, including starch, biocides, and pH adjusting agents such as alum, may be added at the blend chest, at the machine chest, at the stuff box, and/or elsewhere in the system. pH adjusting agents can be added where needed at multiple points along the flow of pulp or treated pulp through the system.

Figure 3:
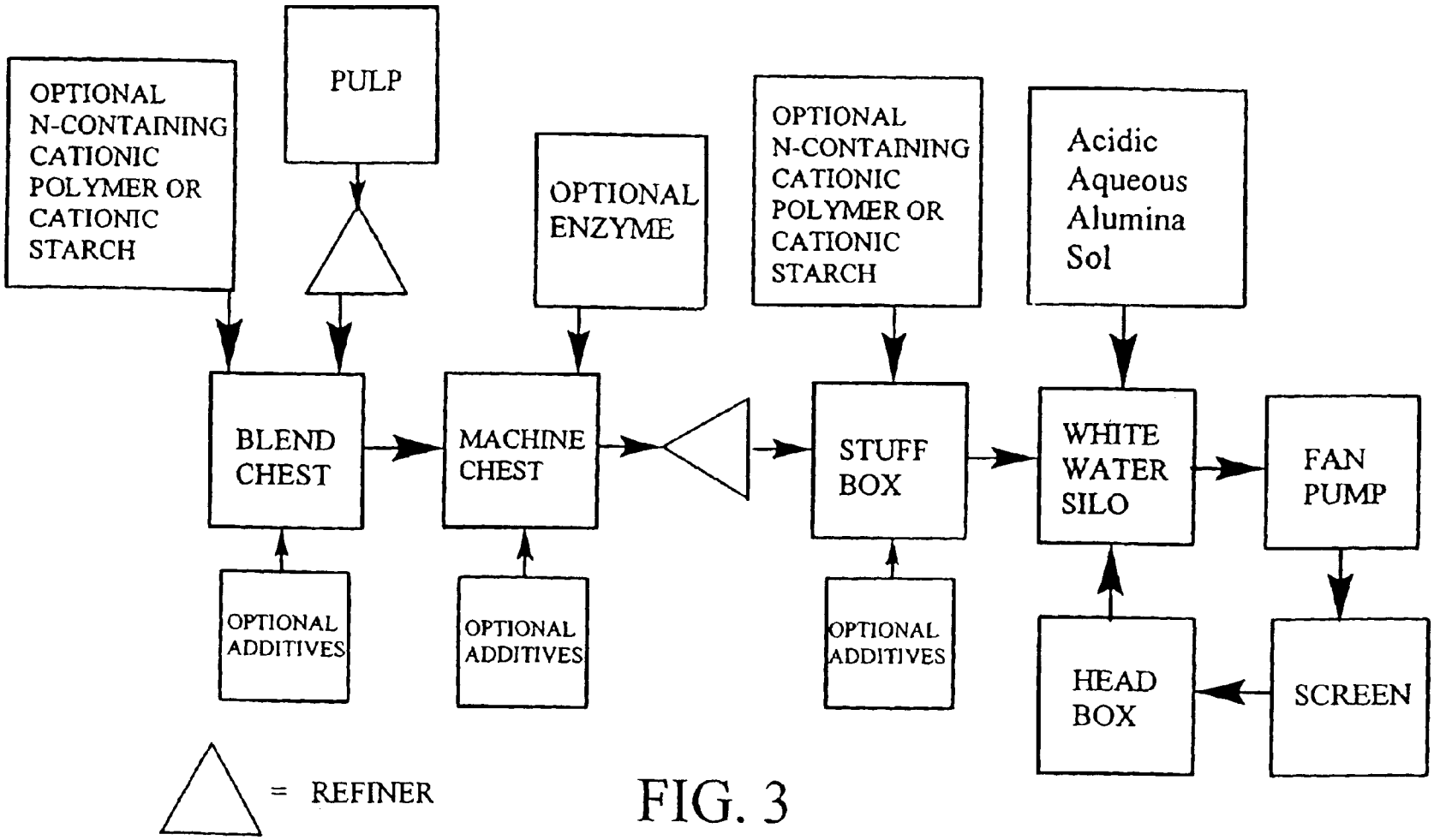
FIG. 3 is a flow chart showing a papermaking process according to another embodiment of the present invention.

Another embodiment of the present invention is depicted in FIG. 3. Pulp is optionally treated in a blend chest with a nitrogen-containing cationic polymer or a cationic starch. The treated pulp is passed from the blend chest to a machine chest wherein an enzyme composition is optionally added to the pulp to form an enzyme-treated pulp. The pulp is then refined and passed to a stuff box where nitrogen-containing cationic polymer or a cationic starch can optionally be added to the pulp. The optional cationic polymer or starch added at the stuff box, if used, may be the same or different than the first cationic polymer or starch optionally added to the pulp at the blend chest. Alternatively, no cationic polymer or starch is added to the pulp at the stuff box. From the stuff box, the pulp is then passed to a white water silo where, in the embodiment shown, the acidic aqueous alumina sol is added to the pulp. The pulp is then passed through a fan pump to a screen and subsequently to a head box. The drained stock resulting from sheet making in the head box is recirculated to the white-water silo.

Other additives, including biocides, pH adjusting agents such as alum, and the like, can be added to the pulp at the blend chest, at the machine chest, at the machine stuff box, and/or elsewhere in the system.

According to the embodiment of the present invention shown in FIG. 3, if a nitrogen-containing cationic polymer composition is added at the blend chest it can be, for instance, a cationic polymer containing acrylamide units and units of a cationic monomer. According to a preferred embodiment of the present invention shown in FIG. 3, at least one of the optional cationic polymer or starch compositions is a starch that is added to the pulp.

The apparatus of the present invention can also include metering devices for providing a suitable concentration of the alumina sol or other additives to the flow of pulp.

A cleaner, for example, a centrifugal force cleaning device, can be disposed between, for instance, the fan pump and the screen, according to any of the embodiments of FIGS. 1–3 above.

The method, system and pulp of the present invention provide a paperweb exhibiting excellent drainage and/or retention of fines. Resulting paper and paperboard made according to the method of the present invention exhibit excellent opaqueness and other desirable physical properties.

The acidic aqueous alumina sol used in the papermaking pulps according to the present invention can also be used, according to embodiments of the invention, to treat waste water streams (or other water streams or holding tanks) and textile dye streams. The sol can be added to a water stream or a textile dye stream to treat the stream in a manner as described with respect to the addition of fibrous cationic colloidal alumina microparticles in WO 97/41063, which is incorporated herein in its entirety by reference.

According to the present invention, a method of flocculating one or more particulate materials present in a dispersion is provided whereby the method includes contacting the dispersion with an amount of acidic aqueous alumina sol sufficient to flocculate at least a portion of the particulate materials. The dispersion can be a water stream, a waste water stream, a textile dye stream, a textile dye waste stream, or other streams or other particulate-containing mixtures, suspensions, dispersions, or solutions. The use of the acidic aqueous alumina sol to treat streams is particularly suitable for flocculating particulate materials present in an aqueous dispersion.

It will be apparent to those skilled in the art that various modifications and variations can be made to the embodiments of the present invention without departing from the spirit or scope of the present invention. Thus, it is intended that the present invention covers other modifications and variations of this invention within the scope of the appended claims and their equivalents.

What is claimed is:

1. A method of making paper or paperboard comprising:

a) introducing at least one acidic aqueous alumina sol and at least one synthetic hectorite microparticle additive to a papermaking pulp to form a treated pulp; and b) forming the treated pulp into paper or paperboard; wherein said acidic aqueous alumina sol contains elongated secondary particles that are elongated from about 50 nm to about 300 nm in only one plane and are formed by edge-to-edge coagulation of rectangular plate-like primary particles having a length on one side of from about 10 nm to about 30 nm when observed through an electron microscope, and wherein said acidic aqueous alumina sol is made of particles having an alumina hydrate boehmite structure and said acidic aqueous alumina sol is added in amounts of from about 0.01% to about 0.5% by weight based on dried solids weight of both said sol and said pulp.

2. The method of claim 1, wherein said sol has a pH of from about 3 to about 6.

3. The method of claim 1, wherein said acidic aqueous alumina sol is added to said pulp in an amount of at least about 0.05 pound based on the dried solids weight of both the sol and the pulp.

4. The method of claim 1, wherein said acidic aqueous alumina sol is added to said pulp in an amount of from about 0.3 pound per ton of paperstock to about 5.0 pounds per ton of paperstock based on the dried solids weight of both the sol and the pulp.

5. The method of claim 1, further comprising introducing at least one anionic polyacrylamide to the pulp.

6. The method of claim 1, further comprising combining at least one cationic starch with said papermaking pulp prior to introducing said at least one acidic aqueous alumina sol to said pulp.

7. The method of claim 1, wherein said pulp comprises a sulfite pulp.

8. The method of claim 1, further comprising introducing at least one polymer composition to the pulp or treated pulp.

9. The method of claim 8, wherein said at least one cationic polymer composition comprises a cationic polyacrylamide polymer.

10. The method of claim 8, wherein said at least one cationic polymer composition is a synthetic, water-soluble cationic polymer containing acrylamide units and cationic monomeric units.

11. The method of claim 1, further comprising adding a high molecular weight cationic polymer to said papermaking pulp, followed by subjecting the suspension to high shear conditions, before adding said acidic aqueous alumina sol.

12. The method of claim 1, further comprising adding at least one cellulytic enzyme to said pulp or treated pulp.

13. The method of claim 1, further comprising adding at least one cellulytic enzyme to said pulp before introducing said acidic aqueous alumina sol to said pulp.

14. A paper or paperboard made according to the method of claim 1.

15. The method of claim 1, wherein said synthetic hectorite microparticle additive is introduced in an amount of from about 0.1 pounds to about 2.0 pounds per ton of pulp, based on dried solids weight of both said additive and said pulp.

16. A paper or paperboard made from a drained paperweb, said paperweb comprising cellulosic fibers, and at least one synthetic hectorite microparticle additive, and from about 0.01% to about 0.5% by weight of an acidic aqueous alumina sol based on dried solids weight of both said sol and said paperweb, wherein said acidic aqueous alumina sol contains elongated secondary particles that are elongated from about 50 nm to about 300 nm in only one plane and are formed by edge-to-edge coagulation of rectangular plate-like primary particles having a length on one side of from about 10 nm to about 30 nm when observed through an electron microscope, and wherein said acidic aqueous alumina sol is made of particles having an alumina hydrate boehmite structure.

17. The paper or paperboard of claim 16, wherein said sol has a pH of from about 3 to about 6.

18. The paper or paperboard of claim 16, wherein said acidic aqueous alumina sol contains elongated secondary particles that are elongated from about 50 nm to about 300 nm in only one plane and are formed by edge-to-edge coagulation of rectangular plate-like primary particles having a length on one side of from about 10 nm to about 30 nm when observed through an electron microscope.

19. The paper or paperboard of claim 16, wherein said synthetic hectorite microparticle additive is present in an amount of from about 0.1 pounds to about 2.0 pounds per tan of paperweb, based on dried solids weight of both said additive and said paperweb.

20. A paper or paperboard made from a drained and dried paperweb formed from a papermaking pulp comprising cellulosic fibers, and at least one synthetic microparticle additive, and from about 0.01% to about 0.5% by weight of an acidic aqueous alumina sol based on dried solids weight of both said sol and said pulp, wherein said acidic aqueous alumina sol contains elongated secondary particles that are elongated from about 50 nm to about 300 nm in only one plane and are formed by edge-to-edge coagulation of rectangular plate-like primary particles having a length on one side of from about 10 nm to about 30 nm when observed through an electron microscope, and wherein said acidic aqueous alumina sol is made of particles having an alumina hydrate boehmite structure.

21. The paper or paperboard of claim 20, wherein said synthetic hectorite microparticle additive is present in an amount of from about 0.1 pounds to about 2.0 pounds per ton of pulp, based on dried solids weight of both said additive and said pulp.

* * * * *

UNITED STATES PATENT AND TRADEMARK OFFICE

CERTIFICATE OF CORRECTION

PATENT NO. : 6,712,933 B2
DATED : March 30, 2004
INVENTOR(S) : Karve et al.

It is certified that error appears in the above-identified patent and that said Letters Patent is hereby corrected as shown below:

Title page,
Item [54], Title, "ACQUEQUS" should read -- AQUEOUS --.
Item [74], *Attorney, Agent, or Firm*, "Kilyk & Bowersoc, P.L.L.C." should read -- Kilyk & Bowersox, P.L.L.C. --.

Column 1,
Line 6, "119(c)" should read -- 119(e) --.

Column 10,
Line 62, "tan" should read -- ton --.
Line 67, "at least one synthetic microparticle" should read -- at least one synthetic hectorite microparticle --.

Signed and Sealed this

First Day of March, 2005

JON W. DUDAS
*Director of the United States Patent and Trademark Office*